US005266225A

United States Patent [19]

Hall et al.

[11] Patent Number: 5,266,225

[45] Date of Patent: Nov. 30, 1993

[54] LUBRICATING OIL AND LUBRICATING OIL ADDITIVES

[75] Inventors: David Hall, Auburn, Ala.; James Hunt, Tucker, Ga.

[73] Assignee: Action Testing and Consulting Laboratory, Inc., Tucker, Ga.

[21] Appl. No.: 814,788

[22] Filed: Dec. 31, 1991

[51] Int. Cl.[5] ..... C10M 135/10

[52] U.S. Cl. ..... 252/32.7 E; 252/33; 252/35; 252/52 A

[58] Field of Search ..... 252/33, 35, 32.7 E

[56] References Cited

U.S. PATENT DOCUMENTS

| | | | |
|---|---|---|---|
| 2,063,473 | 12/1936 | Tietig | 252/35 |
| 2,197,834 | 4/1940 | Reiff | 252/35 |
| 2,228,500 | 1/1941 | Bergstrom | 252/35 |
| 4,094,801 | 6/1978 | Forsberg | 252/39 |
| 4,129,508 | 12/1978 | Friihauf | 252/33 |
| 4,396,515 | 8/1983 | Sturwold | 252/56 R |
| 4,579,666 | 4/1986 | Schroeck | 252/35 |
| 4,655,946 | 4/1987 | Metro | 252/35 |
| 5,021,173 | 6/1991 | Waddoups | 252/35 |

*Primary Examiner*—Ellen M. McAvoy
*Attorney, Agent, or Firm*—John Lezdey

[57] ABSTRACT

Lubricants and lubricant additive compositions which contain as essential ingredients mineral oil and a metallic acid soap. The compositions improve engine efficiency and provide a protective film over sand and grit to prevent engine wear and stoppage.

11 Claims, No Drawings

LUBRICATING OIL AND LUBRICATING OIL ADDITIVES

FIELD OF THE INVENTION

The present invention relates to novel lubricants and lubricant additives. More particularly, the invention provides a lubricating oil and lubricating oil additive which improves engine efficiency, improves lubricating for heavy duty applications, reduces wear and does not result in a carbon build-up in automotive, industrial and commercial equipment.

BACKGROUND OF THE INVENTION

Lubricants are designed and used to provide microscopic film protection to moving parts which reduces friction. Thus the parts run cooler and cleaner so as to provide longer life to moving parts.

Motor fuel and lubricating oil additives available today generally suffer from one or more deficiencies. Either they are used at very high concentrations, or if used at lower, more economical levels, their detergency and other desirable properties are substantially diminished.

The prior oil additives are concerned with the formation of deposits which reduce engine efficiency. The deposits could restrict gas flow mixture of engine intake valves and may cause damage to the piston, piston rings, engine head, etc. However, the additives are not concerned with damage or loss of lubricity from extraneous particles such as sand and dirt.

Many prior art lubricating oil additives contain polymers, such as Teflon, molybdenum compounds such as molybdenum disulfide, graphite, silicone oils, and the like, to provide a smoother surface for the principal oil to function. Such products generally fail under high temperatures and pressures.

It is therefore an object of the present invention to provide a lubrication modifier which has anti-wear characteristics and provides improved lubricity.

It is another object of the invention to provide a lubricant additive for use in connection with automotive and industrial equipment.

It is yet another object of the invention to provide a lubricant which is capable of performing at high temperatures and pressures.

It is a still further object of the invention to improve lubricity of all oils or greases which are used to protect moving parts.

SUMMARY OF THE INVENTION

In accordance with the invention there is provided a lubricant and lubricant additive composition comprising about 10 to 60% by weight of at least one metallic soap; about 20 to 50% by weight of mineral oil; about 5 to 20% by weight of a glycol selected from the group consisting of polyalkylene glycol ether and polyalkylene glycol and about 0 to 10% by weight of zinc dialkylthio phosphate.

Advantageously, the mineral oil includes a percentage of mineral seal oil, preferably in the amount of about 20 to 30% by weight in combination with the mineral oil.

In order to improve the film forming properties of the lubricant composition and promote cleaning, up to about 10% by weight of a zinc dialkylthio phosphate can be added.

The dielectric constant of the lubricant and lubricant additive compositions of the invention should be greater than 25 KV. The preferred compositions have a dielectric constant within the range of about 35 to 52 KV so as to possess good insulating properties.

The composition of the invention have been found to provide anti-wear characteristics under extreme sandy and high pressure conditions. Surprisingly, the compositions of the invention provide a protective film on sand and grit which prevents wear and permits operation of the parts without injury or stoppage.

DESCRIPTION OF THE PREFERRED EMBODIMENTS

The present invention provides an additive for improving the lubricity of motor oils, gear oils, gum oils, transmission oils, greases and the like.

The composition contains about 10 to 60% by weight of at least one metallic acid soap, preferably about 28 to 39%. The metallic acid soap which is preferably used in the invention is a compound of the formula selected from the group consisting of

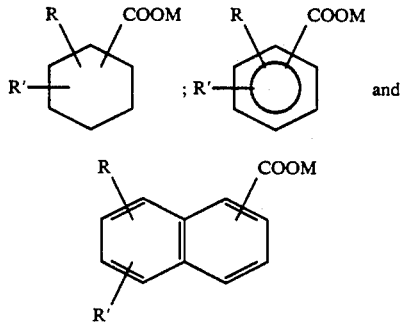

wherein

R is selected from the group consisting of alkylene of 8 to 16 carbon atoms, alkyl of 8 to 16 carbon atoms, —H, —OH, —SH, —OM, —SM —$SO_3M$, and —$COOM_1$, M is a metal ion selected from the group consisting of Mo, Pb, Cd and Bi, and $M_1$ is a metal ion selected from the group consisting of alkali metal, alkaline earth metal, Mo, Pb, Cd and Bi, and R' is a member selected from the group consisting of —H and —$SO_3M_1$ wherein $M_1$ is as hereinbefore described.

The R substituent can have more than one unsaturated site and/or a polar group so as to adjust or increase the dielectric constant of the molecule.

The preferred metallic acid soaps are lead napthanate, lead sulfonaphthanate, cyclohexane lead sulfonate, cyclohexane carboxylic acid lead salt, cyclohexane bismuth sulfonate, cyclohexane cadmium sulfonate, and cyclohexane carboxylic acid bismuth salt.

Although the composition can comprise about 20 to 50% by weight of mineral oil, it is preferable that about 20 to 30% by weight of the composition also includes mineral seal oil.

The mineral oil advantageously is of a medium viscosity.

Representative examples of the mineral oil which can be used include a purified oil which is obtained by purifying a distillate oil by the usual method, said distillate oil having been obtained by atmospheric distillation of a paraffin base crude oil or an intermediate base crude oil, or by vacuum distillation of a residual oil resulting from the atmospheric distillation and a deep dewaxing oil which is obtained by subjecting the above purified oil to deep dewaxing treatment. In this case, the process for purification of the distillate oil is not critical, and various methods can be employed. Usually, the distillate oil is purified by applying such treatments as (a) hydrogenation, (b) dewaxing (solvent dewaxing or hydrogenation dewaxing), (c) solvent extraction, (d) alkali distillation or sulfuric acid treatment, and (e) clay filtration, alone or in combination with one another. It is also effective to apply the same treatment repeatedly at multi-stages. For example, (1) a method in which the distillate oil is hydrogenated, or after hydrogenation, it is further subjected to alkali distillation or sulfuric acid treatment, (2) a method in which the distillate oil is hydrogenated and then is subjected to dewaxing treatment, (3) a method in which the distillate oil is subjected to solvent extraction treatment and then to hydrogenation treatment, (4) a method in which the distillate oil is subjected to two- or three-stage hydrogenation treatment, or after the two or three-stage hydrogenation treatment, it is further subjected to alkali distillation or sulfuric acid rinsing treatment, (5) a method in which after the treatment of the distillate oil by the methods (1) to (4) as described above, it is again subjected to dewaxing treatment to obtain a deep dewaxed oil, and so forth can be employed.

The polyalkylene glycols and polyalkylene glycol ethers are used in the composition in an amount of about 5 to 25% by weight, preferably about 10 to 20% by weight. The alkylene group preferably contains 2 to 4 carbon atoms. The molecular weight of the polyalkylene glycol is preferably about 190 to 9000.

The preferred glycols are polyethylene glycol, polypropylene glycol, polyoxyethylene and polyoxypropylene.

The viscosity of the glycol depends upon the lubricant it is to be added to and as to the final viscosity desired of the composition to which it is added.

The composition may optionally include a zinc dialkylthio phosphate in order to improve the film forming properties of the composition and to remove deposits. Preferably, up to about 10% by weight of the zinc dialkylthio phosphate is used. The alkyl group comprises from 1 to 8 carbon atoms. Methyl is the preferred alkyl group.

A preferable lubricant and lubricant additive of the invention comprises:

about 15 to 25% by weight of mineral oil, about 20 to 30% by weight of mineral seal oil, about 28 to 39% by weight of a metallic acid soap selected from the group consisting of cyclohexane carboxylic acid lead salt and lead naphthanate, about 3 to 8% by weight of zinc dimethylthio phosphate, and about 10 to 15% by weight of a polyalkylene glycol selected from the group consisting of polypropylene glycol and polyethylene glycol.

The compositions of the invention may also be formulated with any of the conventional additives, including antiknock agents, ignition accelerators, combustion improvers, power improvers, cold starting aids, autoignition inhibitors, antioxidants, gum inhibitors, corrosion inhibitors, sludge inhibitors, detergents, metal deactivators, stabilizers, dispersants, tetra-ethyl lead stabilizers, stabilizers for metal carbonyls, varnish inhibitors, upper cylinder lubricants, scavengers, octane-requirement-increase depressants, surface ignition inhibitors, spark plug fouling inhibitors, dyes, foam inhibitors, odor inhibitors, odor masking agents, anti-icing agents, decolorizing agents, odorants, identification markers, freezing point depressants, and flammability suppressors. Usually these additives will be present in existing lubricating oils in amounts of from about 0.5 to 15 weight percent of the total composition. Generally, each of the additives will be present in the range from about 0.01 to 5 weight percent of the total composition.

The composition can be used alone or as additives to lubricating oil, hydraulic oil, gum oil, greases, and the like.

The invention is additionally illustrated in connection with the following Examples which are to be considered as illustrative of the present invention. It should be understood, however, that the invention is not limited to the specific details of the Examples.

EXAMPLE 1

A lubricant and lubricant additive composition is prepared by admixing the following ingredients:

| Ingredient | % Wt |
|---|---|
| Mineral oil (med. vic.) | 20 |
| Mineral seal oil | 25 |
| Lead naphthanate | 34 |
| Polyethylene glycol | 15 |
| Zinc dimethyl thio phosphate | 6 |

The composition has the following specification.

| | |
|---|---|
| Specific gravity @ 60° F. (15.6° C.) | 1.25 g/CC |
| Pour point | −44° F. |
| Viscosity @ 40° (104° F.) | 53.4 SUS |
| @ 100° C. (212° F.) | 34.9 SUS |
| Ash | 0.624% |
| Dielectric constant ASTM D-1816 | 46.6 avg. |
| Flash point - open cup | 360° F. |
| pH | 7.2 |

EXAMPLE 2

A lubricant and lubricant additive is prepared with the following ingredients.

| Ingredients | % Wt |
|---|---|
| Mineral oil (med. vic.) | 20 |
| Mineral seal oil | 25 |
| Cyclohexane lead sulfonate lead salt | 34 |
| Polyethylene glycol | 15 |
| Zinc dimethyl thio phosphate | 6 |

In lieu of cyclohexane lead sulfonate there may be used the molybdenum salt.

3 to 10% by weight of the above composition may be added to conventional motor oil to reduce engine wear at start up.

EXAMPLE 3

A lubricant and lubricant additive composition is prepared by admixing the following ingredients:

| Ingredient | % Wt |
|---|---|
| Mineral oil (med. vic.) | 40 |
| Bismuth sulfonaphthanate | 35 |

-continued

| Ingredient | % Wt |
|---|---|
| Polyethylene glycol | 10 |
| Zinc dimethyl thio phosphate | 6 |
| Polyoxyethylene | 10 |

EXAMPLE 4

A lubricant and lubricant additive composition is prepared by admixing the following ingredients:

| Ingredient | % Wt |
|---|---|
| Mineral oil (med. viscosity) | 20 |
| Mineral seal oil | 25 |
| Cyclohexane carboxylic acid lead salt | 17 |
| Lead naphthanate | 17 |
| Polyethylene glycol | 15 |
| Zinc dialkyl thio phosphate | 6 |
| | 100 |

The composition has an average dielectric constant about 46.

EXAMPLE 5

A lubricant and lubricant additive is prepared with the following ingredients.

| Ingredients | % Wt |
|---|---|
| Mineral oil (med. vic.) | 20 |
| Mineral seal oil | 25 |
| Cyclohexane lead sulfonate lead salt | 34 |
| Polyethylene glycol | 15 |
| Zinc dimethyl thio phosphate | 6 |

In lieu of cyclohexane lead sulfonate there may be used the molybdenum salt.

3 to 10% by weight of the above composition may be added to conventional motor oil to reduce engine wear at start up.

EXAMPLE 6

A. A 1987 Cadillac (Sedan de ville) having 61,000 miles was chosen for the test vehicle. The car used for both long trips and "in and around" town type driving hence was balanced in its driving history.

In order to calibrate the driving behavior, the vehicle oil and filter were changed and the auto was driven under its usual conditions until 69 gallons of gas was consumed. The on board computer indicated 17.6 m.p.g. average. The car was again operated until 58 gallons of gasoline was consumed. The on-board computer indicated a 17.7 m.p.g. average.

The oil and filter was again changed using the same oil except that 5% by weight of the lubricant additive of Example 1 was added. The car was operated under near identical conditions and until 62 gallons of gas was consumed. The on-board computer indicated a 19.4 m.p.g. or a 9.9% increase in fuel efficiency. In another run involving 35 gallons the fuel efficiency was 20.8 m.p.g.

Several factors were noted during the test run. The oil did not appear to be degraded (discolored) and appeared cleaner than the previous oil. Starting performance on cold days appeared to be better. Extra engine acceleration during passing or climbing of steep hills was quicker.

B. The oil was analyzed before and after treatment with the additive. After treatment, less metal contaminates were found in the oil analysis. No wear could be seen under 200x microscope.

Output Horsepower: 15.4% increase standing start—18.6% after 4,000 miles and in overdrive.

Fuel Consumption: 17.6 m.p.g. before application (up to 20.8 m.p.g. after application and after 4,000 miles).

Engine Friction: 14.2% decrease.

Exhaust Emissions: No change after treatment

There is an overall reduction of engine wear; especially on cold starts, wear here is reduced up to 92%. Dynometer tests showed an increase in horsepower and an increase of 175-240 RPM's in engine speed.

EXAMPLE 7

A. Using a standard ASTM test ASTM-D2670-67, the Felex pin Vee Block test of the composition of Example 1 as an additive were tested.

Three oils were used in the Timken test apparatus:

1. Havoline 10W-40
2. Castrol 30W
3. Penzoil 2 -W-40

| | Test Results: | | | | |
|---|---|---|---|---|---|
| Havoline | Havoline and additive | Castrol 30W | Castrol and additive | Penzoil 20-W-40 | Penzoil and additive |
| Current Load AMPS-Max >10 | 5.5 | 8-10 | 6 | >10 | 6.5 |
| Torque at Seizure ft. lbs. 45 | >100NS | 35S | >100NS | 30S | >100NS |

S=Seizure

NS=No Seizure

Test with the lubricant of Example 1 were run with 5% O.W. Oil. On all the tests above, sand was added 50—50 with oil without seizure. Actually, the bearing test ran quieter after sand was added.

B. Other Physical Tests:

Rust prevention—No visible rust at room temperature of crankshaft seal after immersion in the composition of Example 1 and subjecting to moisture for 24 hours.

Effect on seals—Soft rubber O-rings. No visible effect. Hard rubber gaskets. No visible effect.

Measurement of temperature reduction under pressure. Significant temperature drop. Actual valve dependent on reference oil.

What is claimed is:

1. A lubricant and lubricant additive composition essentially consisting of:

about 10 to 60% by weight of at least one metallic acid soap selected from the group consisting of:

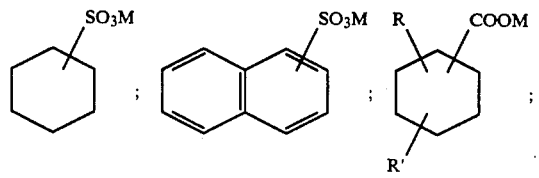

-continued

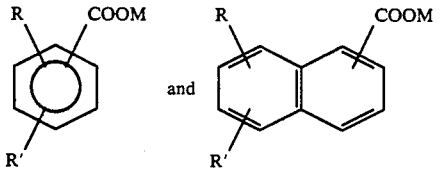

wherein

R is selected from the group consisting of alkyl of 8–16 carbon atoms,

—H, —OH, —SH, $—SO_3M_1$ and $—COOM_1$

M is selected from the group consisting of Mo, Pb, Cd and Bi, $M_1$ is selected from the group consisting of alkali metal, alkaline earth metal, Mo, Pb, Cd and Bi, and R is selected from the group consisting of —H and $—SO_3M_1$ wherein M, is as hereinbefore described, about 20 to 50% by weight of mineral oil, about 5 to 25% by weight of polyalkylene glycol, and about 0 to 10% by weight of zinc dialkyl phosphate having 2 to 10 carbon atoms.

2. A lubricant and lubricant additive composition comprising:

about 15 to 25% by weight of mineral oil, about 20 to 30% by weight of mineral seal oil, about 28 to 39% by weight of a metallic acid soap selected from the group consisting of lead sulfonaphthanate, cadmium sulfonaphthanate, bismuth sulfonaphthanate and lead, naphthanate about 3 to 8% by weight of zinc dimethylthio phosphate and about 10 to 15% by weight of a polyalkylene glycol selected from the group consisting of polypropylene glycol and polyethylene glycol.

3. A lubricant comprising a mixture of a hydrocarbon lubricating grease or oil and the additive composition of claim 2.

4. The lubricant of claim 3 comprising about 3 to 10% by weight of said additive composition.

5. A lubricant and lubricant additive composition which comprises:

about 10 to 60% by weight of at least one metallic soap selected from the group consisting of lead naphthanate, lead sulfonaphthanate, cadmium sulfonaphthanate and bismuth sulfonaphthanate, about 20 to 50% by weight of mineral oil, about 5 to 25% by weight of polyalkylene glycol, and about 0 to 10% by weight of zinc dialkyl phosphate having alkyl groups of 8–16 carbon atoms.

6. The composition of claim 5 wherein said mineral oil includes mineral seal oil.

7. The composition of claim 5 wherein said glycol is selected from the group consisting of polyethylene glycol and polypropylene glycol.

8. The composition of claim 5 wherein said zinc dialkyl thio phosphate is zinc dimethyl thio phosphate.

9. The composition of claim 5 wherein the dielectric constant of said composition is about 35 to 52 KV.

10. A lubricant comprising a mixture of a hydrocarbon lubricating grease or oil and the additive composition of claim 5.

11. The lubricant of claim 10 comprising about 3 to 10% by weight of said additive composition.

* * * * *